US011203918B2

(12) United States Patent
Abdelhamid et al.

(10) Patent No.: US 11,203,918 B2
(45) Date of Patent: Dec. 21, 2021

(54) OIL WELL FLOWBACK WITH ZERO OUTFLOW

(71) Applicant: SAUDI ARABIAN OIL COMPANY, Dhahran (SA)

(72) Inventors: Osama Abdelhamid, Dhahran (SA); Kamran Sabir, Dhahran (SA); Aymen Sieny, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/791,403

(22) Filed: Feb. 14, 2020

(65) Prior Publication Data

US 2021/0254434 A1 Aug. 19, 2021

(51) Int. Cl.

| | |
|---|---|
| ***E21B 41/00*** | (2006.01) |
| ***E21B 49/00*** | (2006.01) |
| ***E21B 34/06*** | (2006.01) |
| ***E21B 33/12*** | (2006.01) |
| ***E21B 43/26*** | (2006.01) |

(52) U.S. Cl.

CPC ..... *E21B 41/0057* (2013.01); *E21B 33/12* (2013.01); *E21B 34/06* (2013.01); *E21B 43/26* (2013.01); *E21B 49/00* (2013.01)

(58) Field of Classification Search

CPC ..... E21B 49/00; E21B 41/0057; E21B 43/26; E21B 33/12

See application file for complete search history.

(56) References Cited

U.S. PATENT DOCUMENTS

| | | | | |
|---|---|---|---|---|
| 5,133,410 | A | 7/1992 | Gadelle et al. | |
| 5,335,732 | A | 8/1994 | McIntyre | |
| 5,497,832 | A | 3/1996 | Stuebinger et al. | |
| 6,328,103 | B1 * | 12/2001 | Pahmiyer ..... | E21B 21/002 166/250.17 |
| 6,382,315 | B1 | 5/2002 | Langseth | |
| 2001/0050170 | A1 | 12/2001 | Woie et al. | |
| 2002/0179304 | A1 | 12/2002 | Michael et al. | |

(Continued)

FOREIGN PATENT DOCUMENTS

| | | | |
|---|---|---|---|
| GB | 2332464 | A | 6/1999 |
| GB | 2357307 | A | 6/2001 |
| WO | 2003036029 | A1 | 5/2003 |

OTHER PUBLICATIONS

International Search Report issued in corresponding International Application No. PCT/US2020/028486, dated Oct. 23, 2020 (4 pages).

(Continued)

*Primary Examiner* — Catherine Loikith

(74) *Attorney, Agent, or Firm* — Osha Bergman Watanabe & Burton LLP

(57) ABSTRACT

A method for recovering reservoir fluids from a target reservoir through a well includes analyzing formation properties of the target reservoir and of formation layers surrounding the target reservoir. A disposal zone is then selected within the target reservoir or the formation layers surrounding the target reservoir that is segregated from the reservoir fluids in the target reservoir. A well completion operation accesses the reservoir fluids in the target reservoir and directs flowback effluent from the well completion operation to the disposal zone using internal oil flooding equipment.

20 Claims, 3 Drawing Sheets

(56) References Cited

U.S. PATENT DOCUMENTS

| | | | |
|---|---|---|---|
| 2004/0163808 | A1 | 8/2004 | Ringgenberg et al. |
| 2008/0093085 | A1 | 4/2008 | Knight et al. |

OTHER PUBLICATIONS

Written Opinion issued in corresponding International Application No. PCT/US2020/028486, dated Oct. 23, 2020 (8 pages).

* cited by examiner

OIL WELL FLOWBACK WITH ZERO OUTFLOW

BACKGROUND

Well flowback or flowback refers to a process by which the fluid(s) used to drill, complete and stimulate a well is recovered from the well at the well surface. Additionally, flowback is performed to test the capacity of flow of the well and to estimate the reservoir deliverability, which is typically performed while the rig is still on location. Flowback is performed during the early life stages of a well and prepares the well to enter a full-fledged production stage. The effluent from a well flowback process typically includes hydrocarbon material (oil/gas), oily solids, oil-water emulsions, drilling and completion fluids and stimulation fluids, including acids pumped in the wellbore for stimulation. It may also contain rock cuttings, sand particles, oily sludge, tar and other reservoir and wellbore effluents.

Requirements are in place to handle well flowback effluent in a way that poses no harm to health, environment and safety of all the stakeholders involved in the operation, while keeping the cost of the operation to a minimum. The current approaches of well flowback include using portable separators and smokeless flares, which uphold the high standards of current health, environment and safety (HES) standards.

For example, in some flowback operations, separation processes may be performed to separate components of the effluent. For example, flowback effluent from a fracturing operation may include large amounts of proppant along with the backflowing fracturing fluid and produced well fluids. Because proppant is damaging to the production equipment, the proppant is often separated out of the flowback effluent during flowback operations, and in some operations, separated at the surface of the well. However, the cost of such operations is typically high.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to methods for recovering reservoir fluids from a target reservoir through a wellbore that include analyzing formation properties of the target reservoir and of formation layers surrounding the target reservoir, selecting a disposal zone within the target reservoir or the formation layers surrounding the target reservoir that is segregated from the reservoir fluids in the target reservoir, performing a well completion operation to access the reservoir fluids in the target reservoir, directing flowback effluent from the well completion operation to the disposal zone, and plugging the disposal zone.

In another aspect, embodiments of the present disclosure relate to methods for completing a well that include drilling a wellbore extending past an impermeable formation into a disposal zone that is separated from a target reservoir, installing a check valve in the wellbore between the disposal zone and the target reservoir, installing an isolation system in the wellbore above the target reservoir, and directing flowback effluent from the wellbore into the disposal zone.

In yet another aspect, embodiments of the present disclosure relate to methods for recovering reservoir fluids from a target reservoir through a wellbore that include selecting a disposal zone that is segregated from a productive zone in the target reservoir, directing flowback effluent from a well completion operation to the disposal zone, testing the flowback effluent while directing the flowback effluent to the disposal zone, and plugging the disposal zone.

Other aspects and advantages of the claimed subject matter will be apparent from the following description and the appended claims.

DETAILED DESCRIPTION

Figure 1:
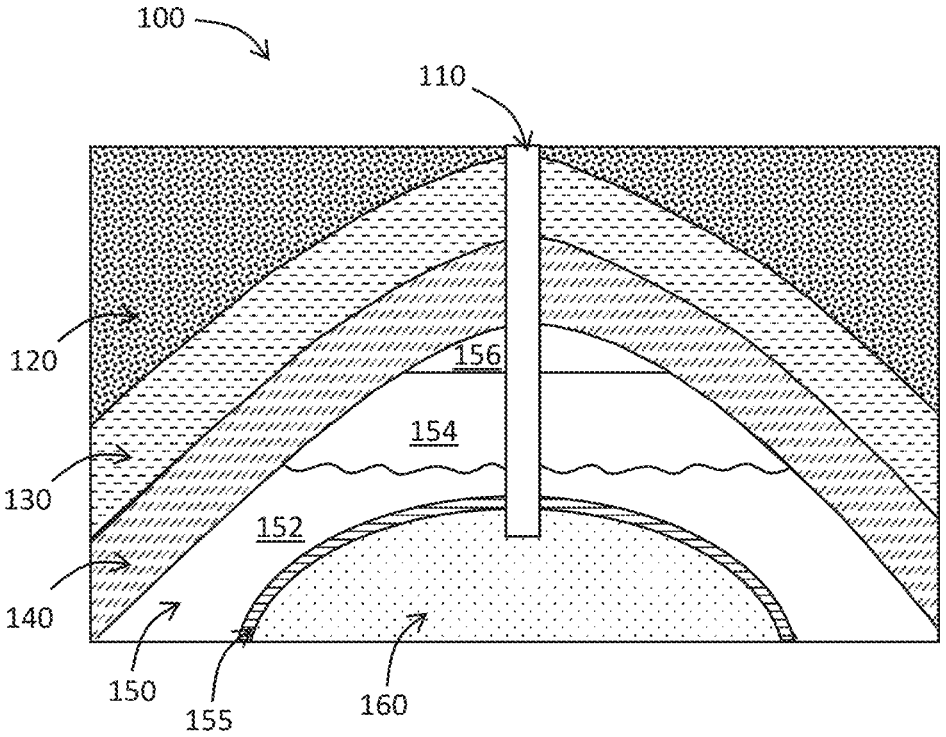
FIG. 1 shows a diagram of a system according to embodiments of the present disclosure.

In one aspect, embodiments disclosed herein relate to a flowback process by which the fluid(s) used to drill, complete, and stimulate a well is removed using what is referred to herein as an "internal oil flooding technique." In contrast to conventional flowback processes, which remove flowback effluent from the well to the surface, the internal oil flooding technique directs flowback effluent into a separate underground formation, referred to herein as a "disposal zone." The injection stream of the well flowback effluents may flow down, usually deeper than the producing formation, into a disposal zone by at least one of three mechanisms including reservoir pressure (i.e., the pressure of the reservoir fluid within the formation pores), gravity force/hydrostatic head pressure, and/or artificial pressure provided by a submersible pump. By using the internal oil flooding technique disclosed herein, a well completion operation may have well flowback with zero outflow (zero produced flowback effluent at the surface of the well) and zero flare (no flaring involved in the flowback process at the surface). Further, internal oil flooding methods described herein may uphold current health, environment, and safety standards while also keeping the costs of the well flowback process to a minimum.

The term "reservoir" is used herein, generally, to refer to an accumulation of producible fluid (e.g., oil, gas, water, etc.) contained within one or more formations. For example, a reservoir may refer to a collection of fluid bounded by impermeable formation, where fluid (e.g., oil and/or gas) is collected in small, connected pore spaces of rock and is trapped within the reservoir by adjacent layers of impermeable rock. A formation in which reservoir fluid is contained may be referred to as a reservoir formation and may include different types of formation layers (e.g., permeable and impermeable formations). Traditionally, hydrocarbon reservoir formations include source rock (rock from which oil and/or gas is formed), reservoir rock (porous, permeable rock that holds the oil and/or gas), and cap rock that traps the hydrocarbons in the reservoir.

Permeability is a physical property of porous materials, which determines the flow of fluid through the reservoir formation rocks by an applied pressure gradient, and may also be described as the "fluid conductivity" of the porous rocks. Permeability may be measured in units of Darcy, normally expressed in millidarcies (mD). The Darcy unit represents the flow capacity required for 1 ml of fluid to flow through 1 $cm^2$ for a distance of 1 cm when 1 atmosphere of pressure is applied. Permeability values vary according to the rock type. For example, in reservoirs considered good producers, permeabilities may commonly be in the range of tens to hundreds of millidarcies. A rock with a permeability of less than 1 mD would not yield a significant flow of liquid, and thus, such "tight" rocks are usually referred to as lower permeable zones. A rock formation with almost zero permeability and no capabilities to transmit the fluid from one layer to another is usually referred to as an impermeable layer. This impermeable layer has zero fluid mobility and acts as a seal or barrier to the flow of fluid therethrough. This seal in a reservoir structure prevents hydrocarbons from further upward migration.

As used herein, a "target reservoir" refers to a reservoir that is targeted to be drilled to for recovery of producible fluid. For example, in well operations discussed herein, a wellbore may be drilled to a target reservoir contained in a reservoir formation for recovery of the producible fluid therein. Formation properties of a target reservoir may vary across the reservoir formation. For example, a productive zone within a target reservoir may have formation properties that allow the reservoir fluid to be more easily accessible through a well operation, whereas other areas within the target reservoir may be inaccessible to the productive zone.

A "wellbore" may refer to a drilled hole in the earth that forms a well, where the inside diameter of the wellbore wall may be a rock face that bounds the drilled hole. A wellbore may be cased (e.g., with steel and/or cement casing) or uncased. An uncased portion of a wellbore may also be referred to as an openhole portion of the well. The term "well" may be used to refer to the wellbore and production equipment therein, such as casing and tubing, and thus, the term "well" is a broader, more general term than "wellbore." As used herein, and depending on the stage of well development, the terms "well" and "wellbore" may sometimes be used interchangeably.

An internal oil flooding method for performing well flowback may be conducted to clean-up and/or test the well after the drilling, completion, and stimulation operations have been conducted on a well by disposing of the wellbore flowback effluent in a disposal zone. A disposal zone may be an underground geological area separated from a target reservoir, such that fluids from the disposal zone and target reservoir are kept separated from each other and do not intermingle. For example, a disposal zone may be in a formation layer different from that of a target reservoir and have no recoverable hydrocarbons, i.e., in a nonproductive formation layer. In some embodiments, a disposal zone may be in a productive reservoir formation layer, but from which oil and/or gas has been produced and no further recovery is to be conducted. Whether the disposal zone is selected from a productive formation layer or nonproductive formation layer, the disposal zone may be selected to maintain segregation from a productive zone in a target reservoir, i.e., an area within the target reservoir from which producible fluid may be recovered. For example, a disposal zone may be selected as an underground location segregated from reservoir fluids in a target reservoir by at least one impermeable formation.

Further, the disposal zone may be selected as a formation having sufficient permeability to assure a minimum required injectivity index so that the disposal flow rate will be high enough to accommodate the well flowback rate. For example, a disposal zone may be selected as a formation having a permeability that is greater than approximately 100 mD. Depending on the properties of the fluid to be injected within the disposal zone, the disposal zone may be selected as a segregated formation having a higher or lower permeability. For example, in cases where extra light oil and/or other low viscosity fluid are to be disposed of, a disposal zone may have a relatively lower permeability, whereas relatively heavier viscous fluids needing disposal may be disposed in a disposal zone having a relatively higher permeability. The disposal zone may further be selected based on its segregation from a productive zone, for example, in a location segregated by formations having a permeability lower than 1 mD (e.g., less than 0.5 mD, less than 0.2 mD, or less than 0.1 mD).

According to some embodiments of the present disclosure, a disposal zone may further be selected as an underground area that may be self-contained by one or more impermeable formation layers entirely surrounding the disposal zone. When a disposal zone is successfully selected, one or more impermeable layers around the disposal zone may act similar to container walls, preventing fluid from entering or leaving the disposal zone, where fluid access to and from the disposal zone may be controlled (e.g., allowed or prevented) through a pilot hole drilled through at least one of the impermeable layer(s) to the disposal zone, and where the pilot hole may be plugged to seal fluid within the disposal zone.

According to embodiments of the present disclosure, a method for recovering reservoir fluids from a target reservoir through a wellbore may include analyzing properties of the target reservoir and of geological formation layers surrounding the target reservoir. Formation studies of the target reservoir and formation layers surrounding the target reservoir may be conducted using any known testing processes. For example, logging operations, core sampling, drill stem tests, seismic testing, and other processes may be performed to retrieve data, such as permeability, pore pressure, reservoir and formation fluid characterization, fluid volumes, etc., about the target reservoir formation and surrounding geological layers.

Analyzing formation properties prior to selecting a disposal zone may help make sure the disposal zone is segregated from a productive zone (and the reservoir fluids to be recovered) in a target reservoir. For example, a study of various formation layers deeper than a target reservoir (farther away from the surface than the target reservoir) may be conducted to select a disposal zone that is deeper than the target reservoir and separated from the target reservoir by at least one impermeable formation layer. In some embodiments, when a disposal zone that invades the target reservoir is selected (instead of a deeper, separate formation layer), studies of the target reservoir may allow locating and selecting the disposal zone in an area of the target reservoir that is separated from a productive zone of the target reservoir. For example, a lower part of a target reservoir formation may be selected as the disposal zone, which is separated from an upper part of the target reservoir formation that is most likely to be the productive zone in the target reservoir (producing fluids to be recovered).

Internal oil flooding techniques disclosed herein may include, generally, processes of disposing well flowback of a wellbore reservoir effluent stream in a disposal zone. While a disposal zone may often be selected as a formation layer that is deeper than the productive zone, a disposal zone may also be selected in a different segregated underground formation (e.g., laterally segregated from the productive zone). In some embodiments, a disposal zone may be selected as part of the reservoir formation itself. For example, reservoir formation layers that were initially filled with hydrocarbon and then depleted and flooded with water (referred to as "swept zones"), where there is no longer remaining hydrocarbon to be produced, may be selected as disposal zones.

As used herein, a "swept zone" may refer to a portion of a reservoir that was initially saturated with hydrocarbon at the stage of reservoir discovery, and after initiating production, may be almost completely flooded with water, where the remaining oil saturation is close to zero and the water saturation is close to or equal to 100%.

In embodiments where a swept zone is selected as a disposal zone, flowback effluent may be injected inside the swept zone below the free water level where the water saturation is approximately 100%. In such embodiments, the injected flowback effluent may be placed inside the swept zone in the reservoir formation itself. When the flowback effluent is injected into a swept zone, the fluid contained therein may include both the flowback effluent and the water. Because oil or other hydrocarbon density is less than water's density, the hydrocarbon portion may, over time, separate and move higher than (closer to the surface) the water portion.

FIG. 1 shows a diagram of an example system 100 according to embodiments of the present disclosure. The system 100 includes a wellbore 110 drilled through a plurality of formations 120, 130, 140, 150, 160, including at least one formation 140 of impermeable rock, a reservoir formation 150, and a disposal zone formation 160. The reservoir formation 150 may include different types of recoverable fluids, for example, water 152, oil 154, and gas 156, and different types of formation layers, e.g., one or more permeable formation layers which may contain recoverable fluids and one or more impermeable formation layers 155. Geological studies may be performed to analyze the formations 120, 130, 140, 150, 160 surrounding the wellbore 110, where data collected from the analysis of the target reservoir (in reservoir formation 150) and of formation layers (140, 160) surrounding the target reservoir may be used to select the location of the disposal zone.

For example, in the embodiment shown, the disposal zone is selected as a disposal zone formation 160 located deeper (i.e., farther away from the surface) than the reservoir formation 150, where the disposal zone 160 is segregated by at least one impermeable formation layer 155. By selecting a disposal zone (in disposal zone formation 160) deeper than the target reservoir (in reservoir formation 150), flowback effluent may be directed into the disposal zone safely and easily with hydrostatic pressure and reservoir pressure in the effluent stream both acting in tandem to enable successful injection in the disposal zone.

Proper segregation of the disposal zone from the reservoir fluids may prevent an injected stream of flowback effluents in the disposal zone from mixing with the reservoir fluids existing in the target reservoir. Further, successful segregation of the flowback effluents in the disposal zone and the reservoir fluids (e.g., hydrocarbons) residing in the target reservoir may preserve the reservoir swept zone and recovery factor. The recovery factor, which may be expressed as a percentage, refers to the recoverable amount of hydrocarbon initially in place, and may be used to measure the completeness of extraction of oil or other hydrocarbon from a bed. Oil recovery also refers to the degree of depletion of an oil bed. A recovery factor coefficient may be defined as the ratio of the quantity of oil extracted to the quantity originally contained in the bed under similar conditions and may be expressed numerically in fractions of a unit or in percentages.

If the segregation between a disposal zone and reservoir fluids is violated, then subsequent well logs (measurements of formation properties from the well) performed in the well may be invalid. Proper segregation of a disposal zone from reservoir fluids in a target reservoir may be achieved by successfully selecting an area of one or more formations that is segregated from the reservoir fluids, e.g., by one or more impermeable layers, which may be determined from analysis of the target reservoir and surrounding geological layers.

In methods of the present disclosure, after a disposal zone has been selected and a well completion operation has been performed to access the reservoir fluids in the target reservoir, flowback effluent from the well completion operation may be directed to the selected disposal zone through a pilot hole drilled between a productive zone in the target reservoir and the disposal zone. As an example, a well completion operation may be a fracturing operation in the target reservoir, where flowback effluent from such operation may include fracturing fluid. In some embodiments, flowback effluent may be blocked from flowing through the wellbore to the surface of the wellbore (e.g., using an isolation system located within the wellbore and above the target reservoir) and instead is directed into the disposal zone.

After completion of well flowback operations and injection of the flowback effluent into the disposal zone, the disposal zone may be plugged to prevent back flow of the injected flowback effluent into the reservoir productive zone. The disposal zone may be plugged using any type of suitable isolation or plug system for a wellbore. For example, cement may be used to plug the disposal zone (e.g., by pumping cement to the disposal zone), a chemical isolation system may be used to plug the disposal zone, or a mechanical plugging system may be used to plug the disposal zone.

In some embodiments, the disposal zone may be plugged, for example, by installing or activating one or more sealing elements to prevent flowback effluent from flowing out of the disposal zone and reservoir fluids from flowing into the disposal zone during recovery of the reservoir fluids. Accordingly, when a disposal zone is located deeper than the productive zone of a target reservoir, an isolation system (e.g., including one or more plugs or sealing elements) may be positioned deeper than the productive zone, between the disposal zone and the productive zone. Once the disposal zone is plugged, the well may enter the production stage, well tie-in activities may commence, and recovery of the reservoir fluids from the target reservoir may begin. Flowback effluent directed to and sealed within a disposal zone may remain there indefinitely.

Figure 2:
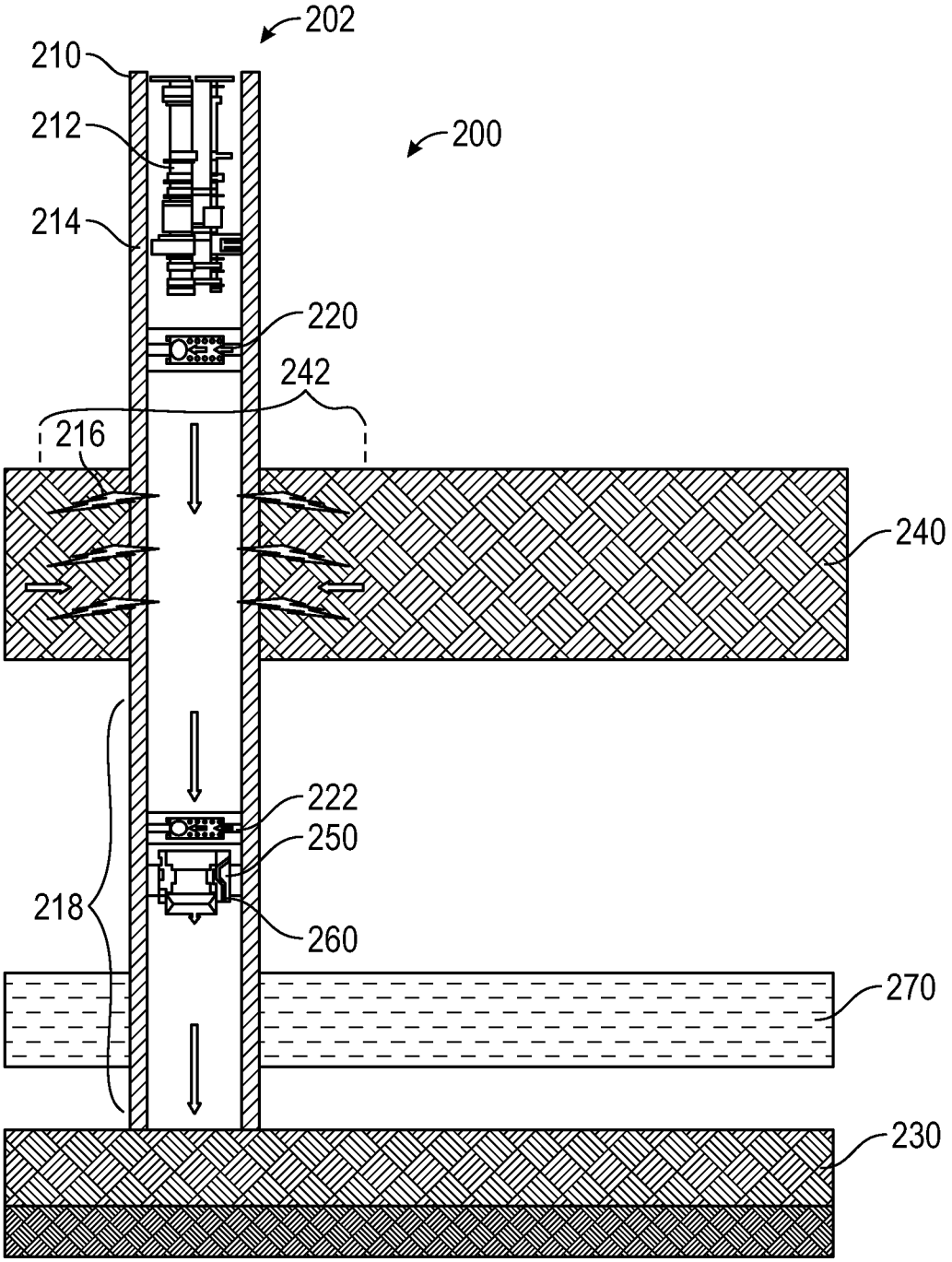
FIG. 2 shows a schematic diagram of a vertical well system according to embodiments of the present disclosure.

According to embodiments of the present disclosure, such as shown in FIG. 2 and discussed below, a disposal zone 230 may be selected in a formation layer deeper than a target reservoir formation 240, where the disposal zone 230 is separated from the productive zone 242 in the target reservoir formation 240 by an impermeable formation layer 270. In embodiments with a disposal zone 230 selected that is deeper than a target reservoir, a wellbore 210 may be drilled extending past both a target reservoir formation 240 and an impermeable formation layer 270 into the disposal zone 230, which is separated from the productive zone 242 in the target reservoir formation 240 by the impermeable formation layer 270.

FIG. 2 shows a schematic diagram of an example of a system 200 for a vertical well 202 according to embodiments of the present disclosure. Referring to the system 200 shown in FIG. 2, steps for performing a well flowback method using internal oil flooding according to embodiments of the present disclosure include making a well ready for production or injection, which may include drilling a wellbore 210 and completion activities such as installing production tubing 212, running in and cementing casing 214, and perforating 216 and stimulating the well.

After making a well ready for production or injection, and before directing flowback effluent to a disposal zone, one or more zone isolation systems 220, 222 may be installed within the well 202. A productive zone isolation system 220 may be installed within the well at a location upstream of a target reservoir formation 240, such that fluid from the target reservoir formation 240 is prevented from flowing to the surface of the well. Further, as shown in FIG. 2, when a disposal zone 230 is chosen to be in a formation layer deeper than a target reservoir formation 240, the productive zone isolation system 220 may be installed above (i.e., closer to the surface) the target reservoir formation 240. For example, the productive zone isolation system 220 may be installed above the productive zone in a reservoir formation.

The productive zone isolation system 220 may include, for example, one or more sealing elements that seal the well 202 and prevent fluid from flowing therethrough and/or one or more valves that may selectively allow fluid to flow therethrough. The productive zone isolation system 220 may be selected, for example, depending on the well completion design and wellbore condition. For example, isolation systems may be selected from an open hole completion scheme, cased hole completion scheme, inflow control devices (ICDs), inflow control valves, etc.

A disposal zone isolation system 222 may be installed within a pilot hole section 218 of the well 202 between the target reservoir formation 240 and the selected disposal zone 230, such that flow of fluid from the disposal zone 230 into the productive zone is prevented. A disposal zone isolation system 222 may include, for example, a one-way valve (e.g., a check valve) held in a location along the well by a housing and/or one or more sealing elements, such as packers, where fluid may be directed through the one-way valve in a direction from the target reservoir formation 240 to the disposal zone 230 (during the flowback process), but prevented from flowing through the one-way valve in a direction from the disposal zone 230 to the target reservoir formation 240. After the flowback process is complete, the disposal zone isolation system 222 may be closed, to prevent fluid flow in either direction, or a separate plug may be used to prevent fluid flow between the disposal zone 230 and the target reservoir formation 240. For example, if a one-way valve is used to prevent back flow during injection of well flowback into the disposal zone, the one-way valve may be removed after the well flowback operation, and a separate plug may be installed to prevent fluid in the disposal zone from escaping.

In some embodiments, a disposal zone isolation system 222 may be a mechanical isolation system using mechanical packers, hydraulic breakers, or inflatable casing packers, for example. In some embodiments, the disposal zone isolation system may be implemented using a cement plug or chemical isolation plugs designed to prevent fluid flow from one zone to another.

When a productive zone isolation system 220 is installed, and upward flow from the productive zone to the surface of the well has been obstructed, fluid pressure below the productive zone isolation system 220 may increase, which may create a force on the fluid trapped below the productive zone isolation system 220 to be directed toward the disposal zone 230. The fluid pressure generated internally from within the target reservoir formation 240 may be referred to as the reservoir pressure of the target reservoir formation. In addition to the internal reservoir pressure, hydrostatic fluid pressure of the fluids trapped below the productive zone isolation system 220 may assist in directing fluid toward the disposal zone 230. The disposal zone isolation system 222 (e.g., a one-way check valve) may allow the generated well effluent to flow from the target reservoir formation 240 into the disposal zone 230 (using internal reservoir and hydrostatic fluid pressures), while at the same time preventing backflow of fluid from the disposal zone 230 back to the target reservoir formation 240.

When reservoir pressure from the target reservoir formation 240 and hydrostatic pressure exert sufficient force to inject well flowback effluent into the disposal zone 230, flowback into the disposal zone 230 may be automatic upon sealing the productive zone isolation system 220, and would not need additional intervention to inject the flowback effluent into the disposal zone 230. In such case, the injection pressure (from internal reservoir pressure in the target reservoir formation and hydrostatic pressure) of the flowback effluent in the well close to the disposal zone 230 is higher than the reservoir/rock pressure in the disposal zone 230.

According to embodiments of the present disclosure, some flowback processes may further include pumping flowback effluent to the disposal zone. For example, in embodiments where the injection pressure (from reservoir pressure in the target reservoir formation 240 and hydrostatic pressure) of the flowback effluent in the well 202 close to the disposal zone 230 is less than the reservoir pressure in the disposal zone 230, injection of the flowback effluent may not be successful without additional intervention in the form of externally provided pressure. Externally provided pressure may be generated using one or more pumps 250 positioned in the well 202 below the productive zone isolation system 220. Suitable pumps 250 for providing additional injection pressure may include, for example, inverted electrical submersible pumps or other downhole fluid pumps.

As shown in FIG. 2, a pump 250 may be installed in the wellbore 210 below a one-way valve (in disposal zone isolation system 222) to provide the flowback effluent stream with sufficient injection pressure for the flowback effluent to invade the disposal zone 230.

According to embodiments of the present disclosure, real time pressure, temperature and production data may be collected and recorded using one or more sensors 260, for example, from sensors 260 disposed at the pump 250, sensors along the disposal zone isolation system 222 and/or sensors along the productive zone isolation system 220. Data from downhole sensors 260 may be communicated to the wellhead at the surface of the well 202 in real time to provide reservoir data about the productive zone and/or the disposal zone. For example, pressure, temperature, flowrate, and/or other data collected from a pump 250 may allow surveillance and monitoring of the flowback process as it is conducted.

Based on the conditions of the fluids in the well, target reservoir formation 240, disposal zone 230, and the well 202, which may be determined at least partially by data collected during the flowback process, an operator (e.g., a reservoir engineer) may make a decision on the time period for conducting the flowback process. A flowback process using the internal oil flooding technique disclosed herein may take a less amount of time, the same amount of time, or in some cases more time than a traditional wellbore clean-up process (where traditional wellbore clean-ups may typically take about 6-12 hours).

Upon directing flowback effluent to a disposal zone using the internal oil flooding technique of the present disclosure, a well test analysis may be performed from data collected downhole to analyze conditions downhole and/or production fluids. A well test analysis may include the process of producing a well for a time interval to collect data to measure, analyze and understand the well behavior in real time. Further, a well test may include acquiring data on the hydrocarbon properties, reservoir temperature and pressure, drainage area and shape, and water-to-oil and gas-to-oil ratios. In order to acquire the most accurate data, downhole and real time sensors may be used. Testing a well may be used in field evaluation and further development and can help ensure that the facility design is fit-for-purpose and that there is no over-capacity or under-capacity for the entire life of the field/project. Information obtained through well testing may be used in conjunction with other data to gain better understanding about reservoir/well.

The well test analysis may be conducted using the downhole data collected during and after internal oil flooding of the disposal zone, e.g., from sensors on a pump or isolation system in an internal oil flooding system. The well test analysis may allow well testing with no wellbore storage effects recorded in the test (e.g., temperature and pressure changes from storage), as the flowrate reading and pressure reading may be taken under downhole reservoir conditions.

After a well test analysis is performed, the well may undergo a post well flowback clean-up process before entering the production stage. The post well flowback clean-up may include taking out and/or disabling equipment used for the internal oil flooding technique (e.g., the isolation systems 220, 222 and/or the pump 250) and plugging the disposal zone 230 (e.g., using cement, a chemical plug, or a mechanical plug). Plugging the disposal zone 230 traps the flowback effluent within the disposal zone 230, where a combination of the plug and the impermeable layers surrounding the disposal zone 230 contain the flowback effluent in the disposal zone 230. Once the well is cleaned and plugged, the well may enter the production stage, and well tie-in activities may commence.

The processes described above with reference to FIG. 2 may be altered, for example, depending on formation characteristics, available equipment, and/or wellbore direction. For example, methods for completing a well according to embodiments of the present disclosure may include drilling a wellbore extending past an impermeable formation into a disposal zone that is separated from a target reservoir, installing a check valve in the wellbore between the disposal zone and the target reservoir, installing an isolation system in the wellbore above the target reservoir, and directing flowback effluent from the wellbore into the disposal zone. After flowback effluent is directed into the disposal zone, the check valve and the isolation system may be removed, and then the disposal zone may be plugged.

In some embodiments, methods may include drilling a wellbore extending past an impermeable formation into a disposal zone that is separated from a target reservoir, installing a pump (e.g., an electrical submersible pump) in the wellbore between the disposal zone and the target reservoir, installing a check valve in the wellbore between the disposal zone and the target reservoir and above the pump, installing an isolation system in the wellbore above the target reservoir, and directing flowback effluent from the wellbore into the disposal zone. Properties of the flowback effluent, such as the properties of the produced fluids, fracturing fluid, wastewater, pressure, temperature, viscosity, and mobility, may be tested using sensors positioned in the wellbore as the flowback effluent is directed into the disposal zone. After flowback effluent is directed into the disposal zone, the pump, the check valve, and the isolation system may be removed, and then the disposal zone may be plugged.

Further, methods of the present disclosure may include drilling a single wellbore to access both the target reservoir 240 and the disposal zone 230, such as shown in FIG. 2, where the portion of the wellbore 210 extending from the target reservoir 240 to the disposal zone 230 may be referred to as the pilot hole portion of the wellbore 210. In other embodiments, such as shown and described in reference to FIG. 3, a pilot hole may branch from a main wellbore, where the main wellbore may access the target reservoir and the pilot hole may extend from the target reservoir to the disposal zone, as discussed below.

Figure 3:
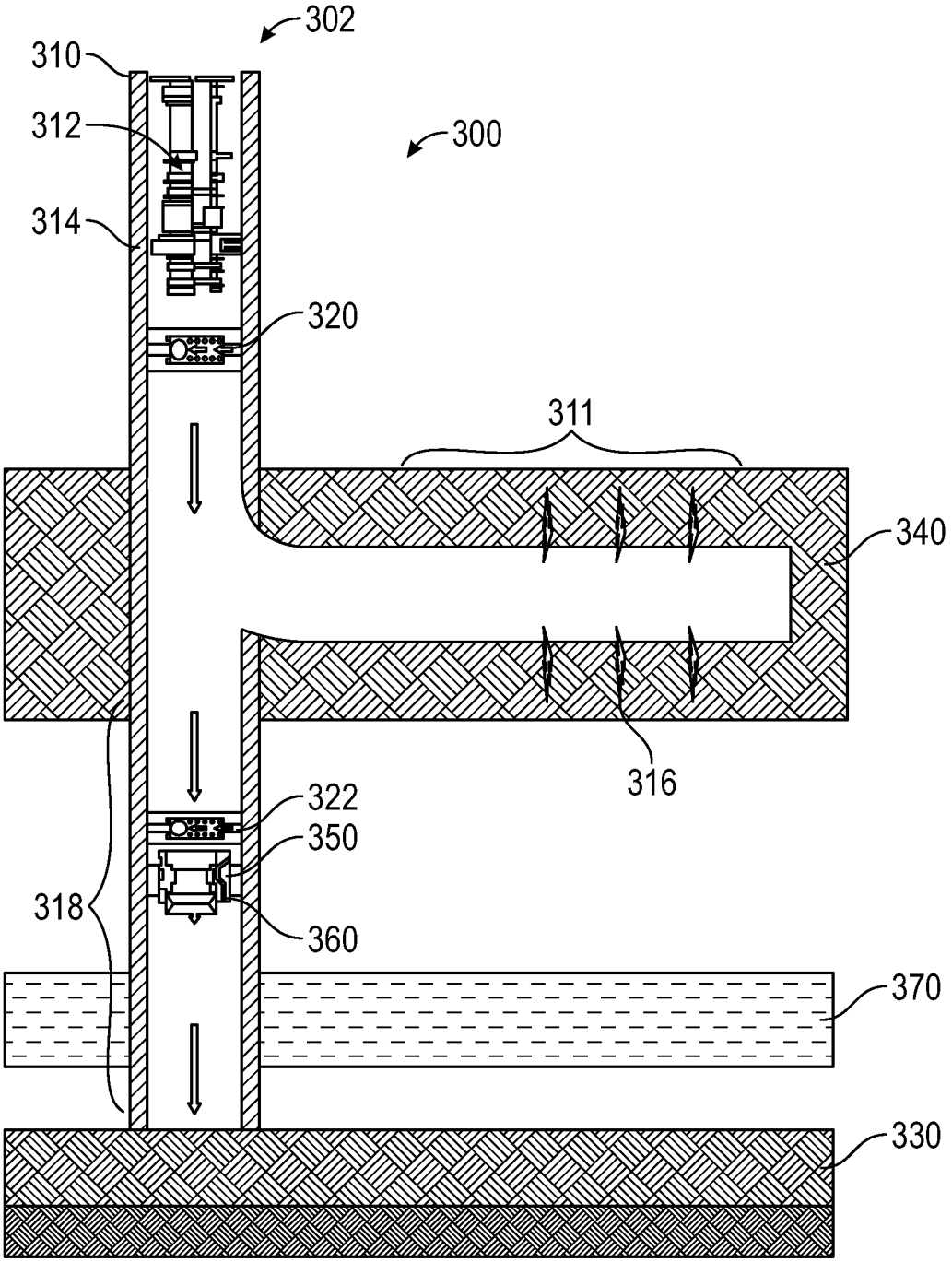
FIG. 3 shows a schematic diagram of a horizontal well system according to embodiments of the present disclosure.

FIG. 3 shows a schematic diagram of an example of a system 300 for a horizontal well 302 according to embodiments of the present disclosure. Referring to the system 300 shown in FIG. 3, steps for performing a well flowback method for a horizontal well using internal oil flooding techniques according to embodiments of the present disclosure may include first making the well 302 ready for production or injection, which may include drilling a wellbore 310 and completion activities such as installing production tubing 312, running in and cementing casing 314, and perforating 316 and stimulating the well. Drilling a wellbore 310 may include drilling both a horizontal section 311 of the wellbore 310 and drilling a pilot hole 318 extending off the main wellbore 310 and into a disposal zone 330.

In the embodiment shown in FIG. 3, the pilot hole 318 extends vertically from the main wellbore 310 to a disposal zone 330 that is deeper than the target reservoir formation 340 and segregated from the target reservoir formation 340 by at least one impermeable formation 370. Selection of the disposal zone 330 may be based on the same criteria and process as performed for a vertical well (e.g., as described above with reference to FIG. 2). For example, downhole data may be collected to determine an underground area or formation that is segregated from a productive zone in a target reservoir formation, and the determined segregated area may be selected as the disposal zone. According to embodiments of the present disclosure, a disposal zone may be selected as an underground area segregated by at least one impermeable layer from a productive zone of hydrocarbons, where the disposal zone is vertically separated from (e.g., located deeper from the surface than) the productive zone and/or laterally separated from the productive zone.

The system 300 shown in FIG. 3 may be set up for a hydraulic fracturing ("fracking") operation. In some fracking operations, the horizontal section 311 may be drilled through the target reservoir formation 340, cased and cemented, perforated (e.g., using a perforating gun or other tool for creating cracks through the casing and adjacent formation), and stimulated (e.g., by pumping a fracturing fluid and/or acid downhole). After the well 302 has been completed (including stimulating, if stimulating is to be performed), the well 302 is ready for production.

Once the well 302 is made ready for production, internal oil flooding equipment (equipment for performing a flowback method using the internal oil flooding technique disclosed herein) may be installed downhole in the well 302. Internal oil flooding equipment may include, for example, one or more isolation systems (including, e.g., valves, packing elements, other sealing elements, and housing), one or more one-way valves, one or more pumps, and/or one or more plugs. Different types of isolation systems may be used depending on, for example, availability of equipment, downhole pressure environment, etc., and may be selected for use at a particular well site to prevent fluids from flowing to the surface of the well. A one-way valve (e.g., a check valve) may be used in one or more isolation systems to prevent fluid from flowing in a direction toward the surface of the well. Further, a plug may be used in an isolation system to prevent fluid from flowing in both the direction toward the surface of the well and away from the surface of the well, for example, by having one or more sealing elements that seal the entire diameter of the well.

In the embodiment shown, an isolation system 320 may be disposed in the wellbore 310 above the target reservoir formation 340 to prevent fluid flow from the target reservoir formation 340 to the surface of the well. An isolation system having a one-way valve 322 may be disposed in the wellbore 310 between the target reservoir formation 340 and the disposal zone 330 within the pilot hole 318 section of the wellbore 310 to prevent fluid flow from the disposal zone 330 to the target reservoir formation 340. An inverted electrical submersible pump 350 may also be disposed in the pilot hole 318 section of the wellbore 310 between the one-way valve 322 and the disposal zone 330.

At least one sensor 360 may be positioned in the wellbore 310 between the target reservoir formation 340 and the disposal zone 330, which may be used to collect data (e.g., temperature, pressure, multiphase flow rate) for a well-test analysis. Data collected from the sensor(s) during the flowback method may be transmitted to the surface in real time for use in making subsequent decisions about the flowback method (e.g., how long to conduct the flowback) and/or subsequent production. One or more sensors 360 may be positioned downhole on the internal oil flooding equipment, e.g., on the inverted electrical submersible pump 350. By using sensors 360 positioned downhole and collecting well data from such sensors 360, well testing may be performed during an internal oil flooding process without bringing fluid to the surface of the well 302.

After well flowback and well-test analysis has been performed, a post well flowback procedure may be performed before entering the production stage. The post well flowback procedure may include removing and/or disabling the internal oil flooding equipment (e.g., isolation system 320, one-way valve 322 and inverted electrical submersible pump 350) from the well 302 and plugging the disposal zone 330. In some embodiments, plugging the disposal zone 330 may include sending a plug downhole to a fixed position along the well 302 between the disposal zone 330 and the productive zone in the target reservoir formation 340, where the plug may seal the entire diameter of the well to prevent fluid from flowing out of the disposal zone 330.

In some embodiments, internal oil flooding equipment removed from one operation may be re-used in a different operation. For example, the same internal oil flooding equipment can be used in one or more different flowback methods at different well sites using the internal oil flooding technique disclosed herein.

After post well flowback clean-up has been performed and the disposal zone 330 plugged, the well may be ready for the production stage, and well tie-in activities can commence.

As described above, flowback refers to a process by which the fluid(s) used to drill, complete and stimulate the well are recovered from the well, which conventionally took place at the well surface. Using internal oil flooding methods disclosed herein, flowback may be done without sending the effluent to the well surface. Flowback allows fluids to flow from the well following a treatment, in preparation for well cleanup and before returning the well to production. The effluent from a well flowback process typically consists of hydrocarbon material (oil/gas), oily solids, oil-water emulsions, drilling and completion fluids and stimulation fluids, including acids pumped in the wellbore for stimulation. Effluent may also contain rock cuttings, sand particles, oily sludge, tar and other reservoir and wellbore effluents. Additionally, flowback may be performed to test the capacity of flow of the well, measuring pressure in the reservoir, estimating volume and oil-in-place, estimating the reservoir deliverability, well capacity, permeability (ability of liquids to flow through the rock), wellbore damage indicators, wellbore storage effects, and reservoir boundaries (identifying information on shape, size and geological complexity of the reservoir).

When performing internal oil flooding methods of the present disclosure, a negligible loss of produced hydrocarbons may come out mixed with flowback effluents to be injected into a disposal zone. However, similar amounts of produced hydrocarbons are lost in traditional flowback processes. Thus, internal oil flooding methods disclosed herein may dispose of flowback effluents with minimal or no additional loss of hydrocarbons when compared to amounts lost in traditional flowback processes. Additional advantages attributed to the internal oil flooding methods disclosed herein include easy treatment of sour crude, elimination of crowding equipment used with conventional flaring systems, and the elimination of liquid hold-up and sludge blocking that usually occur during traditional well flowback processes.

Internal oil flooding methods and systems disclosed herein may allow for cost effective well flowback without sacrificing health, environment, and safety factors. By successfully selecting a disposal zone that is contained within one or more impermeable formation layers, such that the disposal zone is entirely segregated from a productive zone of a target reservoir formation, the flowback effluent may be held within the underground disposal zone without leaking fluid to the remaining environment. Further, because well flowback effluent is injected and held underground in the disposal zone rather than being brought up to the surface (zero outflow), human health concerns may also be avoided, as there would be no human contact with the flowback effluent. With zero outflow of flowback effluent to the surface, there would also be zero flaring of hydrocarbons using internal oil flooding techniques of the present disclosure, which would minimize environmental concerns, as well. Since flowback surface equipment such as flaring and/or storage equipment is not needed for internal oil flooding flowback methods of the present disclosure, more room at the surface of the well may be available (e.g., less restricted deck space on an offshore platform).

Flowback effluent commonly contains oily sludge, particulate matter and other reservoir effluents, which may include the fluids used to drill and complete the well, as well as $H_2S$ in case of sour crude, sand particles and rock cuttings from the reservoir. Using internal oil flooding methods and systems disclosed herein may allow for disposal of such flowback effluent, including oil sludge, solid particulate matter, well drilling and completion fluid(s) (e.g., fracking fluids), in the disposal zone prior to starting production, such that no flowback effluent is in the production stream. Advantageously, this may reduce or eliminate the possibility of the oil sludge blocking the wellbore during production. Further, sour crude can be treated in the same manner as sweet crude and safely and effectively disposed of in the disposal zone using internal oil flooding techniques disclosed herein. For example, instead of adding material to neutralize sour crude, the hydrocarbons containing $H_2S$ may be directly injected into the disposal zone without additional treatment.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method for recovering reservoir fluids from a target reservoir through a well, comprising:

analyzing formation properties of the target reservoir and of formation layers surrounding the target reservoir;

selecting a disposal zone within the target reservoir or the formation layers surrounding the target reservoir that is segregated from the reservoir fluids in the target reservoir;

performing a well completion operation to access the reservoir fluids in the target reservoir;

installing internal oil flooding equipment in the well, the internal oil flooding equipment comprising:

a check valve installed above the disposal zone; and an isolation system installed above the check valve, wherein the isolation system seals an entire diameter of the well; and directing flowback effluent from the well completion operation to the disposal zone using the internal oil flooding equipment.

2. The method of claim 1, further comprising commencing recovery of the reservoir fluids in the target reservoir after plugging the disposal zone.

3. The method of claim 1, wherein the disposal zone is segregated from the reservoir fluids by an impermeable formation.

4. The method of claim 1, wherein the well completion operation comprises a fracturing operation in the target reservoir, and the flowback effluent comprises fracturing fluid.

5. The method of claim 1, wherein the internal oil flooding equipment further comprises at least one pump positioned between the disposal zone and the check valve, the method further comprising pumping the flowback effluent to the disposal zone while the isolation system seals the well.

6. The method of claim 1, further comprising blocking the flowback effluent from flowing through the well to a wellhead of the well while directing the flowback effluent to the disposal zone.

7. A method for completing a well, comprising:

drilling a wellbore extending past an impermeable formation into a disposal zone that is separated from a target reservoir;

installing a check valve in the well between the disposal zone and the target reservoir;

installing an isolation system in the well above the target reservoir;

using the isolation system to entirely seal the well and block fluid flow above the target reservoir; and directing flowback effluent from the well into the disposal zone using hydrostatic fluid pressure of the flowback effluent blocked below the isolation system.

8. The method of claim 7, further comprising removing the check valve and the isolation system after directing the flowback effluent into the disposal zone.

9. The method of claim 8, further comprising plugging the disposal zone after the check valve and the isolation system have been removed.

10. The method of claim 7, further comprising testing properties of the flowback effluent using sensors positioned in the wellbore as the flowback effluent is directed into the disposal zone.

11. The method of claim 7, further comprising stimulating the wellbore prior to installing the check valve and the isolation system and prior to directing the flowback effluent into the disposal zone.

12. The method of claim 7, further comprising performing at least one logging operation to test properties of the wellbore.

13. The method of claim 7, wherein the isolation system comprises at least one sealing element that is activated to seal the well.

14. The method of claim 7, wherein the isolation system comprises at least one valve that selectively allows fluid to flow therethrough, the method further comprising:

closing the at least one valve to seal the well and automatically direct the flowback effluent to the disposal zone.

15. A method for recovering reservoir fluids from a target reservoir through a well, comprising:

selecting a disposal zone that is segregated from a productive zone in the target reservoir;

installing a pump in the well between the disposal zone and the productive zone;

installing a check valve in the well between the disposal zone and the productive zone and above the pump;

installing an isolation system in the well above the productive zone;

directing flowback effluent from a well completion operation to the disposal zone while the isolation system seals an entire diameter of the well; and plugging the disposal zone.

16. The method of claim 15, wherein the well comprises a horizontally drilled section, and the disposal zone is located deeper than the horizontally drilled section from a surface of the well.

17. The method of claim 15, wherein the well is a substantially vertical well.

18. The method of claim 15, wherein the disposal zone is segregated from the target reservoir by at least one impermeable formation.

19. The method of claim 15, further comprising positioning at least one sensor in a pilot hole section of the well extending between the productive zone and the disposal zone to test the flowback effluent as the flowback effluent is directed to the disposal zone.

20. The method of claim 15, wherein the directing the flowback effluent to the disposal zone comprises pumping the flowback effluent with at least one pump disposed in a pilot hole section of the well extending between the productive zone and the disposal zone.

* * * * *